US005795372A

United States Patent [19]

Hill et al.

[11] Patent Number: 5,795,372

[45] Date of Patent: Aug. 18, 1998

[54] NITROGEN-FREE CORROSION INHIBITORS HAVING A GOOD BUFFERING EFFECT

[75] Inventors: Karlheinz Hill, Erkrath; Sigrid Igelmund, Duesseldorf; Bernd Stedry, Kempen; Juergen Geke, Duesseldorf; Andreas Wilde, Duesseldorf; Harald Kuester, Duesseldorf, all of Germany

[73] Assignee: Henkel Kommanditgesellschaft auf Aktien, Duesseldorf, Germany

[21] Appl. No.: 860,109

[22] PCT Filed: Dec. 8, 1995

[86] PCT No.: PCT/EP95/04844

§ 371 Date: Jun. 16, 1997

§ 102(e) Date: Jun. 16, 1997

[87] PCT Pub. No.: WO96/18757

PCT Pub. Date: Jun. 20, 1996

[30] Foreign Application Priority Data

Dec. 16, 1994 [DE] Germany ..... 44 44 878.3

[51] Int. Cl.[6] ..... C23F 11/12; C23F 11/10

[52] U.S. Cl. ..... 106/14.41; 106/14.13; 106/14.43; 252/393; 252/395; 252/396; 422/17

[58] Field of Search ..... 106/14.41, 14.43, 106/14.13; 252/393, 395, 396; 422/17

[56] References Cited

U.S. PATENT DOCUMENTS

| | | | |
|---|---|---|---|
| 5,085,793 | 2/1992 | Burns et al. | 252/396 |
| 5,230,730 | 7/1993 | Speckmann et al. | 106/14.41 |
| 5,507,861 | 4/1996 | Caupin et al. | 106/14.13 |
| 5,556,451 | 9/1996 | Minevski | 106/14.41 |

FOREIGN PATENT DOCUMENTS

| | | |
|---|---|---|
| 0 294 649 | 12/1988 | European Pat. Off. . |
| 0 341 536 | 11/1989 | European Pat. Off. . |
| 0346 138 | 12/1989 | European Pat. Off. . |
| 556 087 | 8/1993 | European Pat. Off. . |
| 2 275 546 | 1/1976 | France . |
| 42 29 848 | 3/1994 | Germany . |
| 43 23 909 | 1/1995 | Germany . |
| 51 093 741 | 8/1976 | Japan . |
| 56 120 791 | 9/1981 | Japan . |
| 58 133 382 | 8/1983 | Japan . |
| 1 238 205 | 7/1971 | United Kingdom . |
| WO95/02714 | 1/1995 | WIPO . |

OTHER PUBLICATIONS

WPIDS Abstract No. 86–222276 which is an abstract of Japanese Patent Specification No. 61–153290 (Jul. 1986).

WPIDS Abstract No. 90–305996 which is an abstract of German Patent Specification No. 3.910.042 (Aug. 1990).

Dissoziationskonstanten sehr schwacher Säuren, Monatshefte, 80:660–62 (1949) No Month.

Grundlagen der allgemeinen und anorganischen Chem, Verlag Sauerländer, 4:353–72 (1973) No Month.

J. Chem. Soc., 19–20 (1944) No Month.

CRC Handbook of Chemistry and Physics, 75th Ed., 8–51 (1994) No Month.

Dictionary of Organic Compounds, vol. 2:1000–1001 (1982) No Month.

Dictionary of Organic Compounds, vol. 3: 3207 (1982) No Month.

*Primary Examiner*—Anthony Green

*Attorney, Agent, or Firm*—Wayne C. Jaeschke; Real J. Grandmaison; Glenn E. J. Murphy

[57] ABSTRACT

Nitrogen-free aqueous anticorrosion composition containing a) a carboxylic acid having 6 to 44 carbon atoms; and b) aromatic hydroxy compounds having a $pK_a$ value in the range of 7.0 to 11 for the hydroxy group, in a weight ratio of 1:2 to 20:1, in the form of a concentrate to be diluted with water by a factor of between 20 and 200 and in the form of a ready-to-use aqueous preparation that preferably contains 0.2 to 2 wt % component a) and 0.1 to 0.6 wt % component b) and has a pH value in the range of 7 to 11.

11 Claims, No Drawings

NITROGEN-FREE CORROSION INHIBITORS HAVING A GOOD BUFFERING EFFECT

BACKGROUND OF THE INVENTION

1. Field of the Invention

This invention relates to corrosion control formulations in the form of an aqueous emulsion or preferably an aqueous solution for temporarily protecting metal surfaces, more particularly iron-containing surfaces, against corrosion. To avoid wastewater pollution, they are free from nitrogen and are distinguished by a good buffering effect so that, despite the possible introduction and/or microbiological production of acids, their alkaline pH value can be maintained for prolonged periods.

2. Discussion of the Related Art

The protection of metals susceptible to corrosion, for example iron, aluminium, zinc, copper or their alloys, against corrosion is a widespread technical problem. It arises in particular when the metal parts are not, or not yet, covered with a permanently corrosion-inhibiting coating, for example in the form of a paint, on account of the particular condition in which they are being treated or on account of their particular field of application. Examples of this are metal parts involved in technical treatment stages such as, for example, machining or forming or cleaning and assembled metal components such as, for example, heat exchangers or pipelines which come into contact in service with corrosive aqueous media. In order to prevent or inhibit corrosion during or between the individual treatment steps or during the intended use, the metal surfaces are contacted with corrosion inhibitors which provide temporary protection against corrosion. It is often necessary for technical reasons, for example in water-based cooling or heating circuits, or desirable in the interests of pollution control, for example during or after cleaning of the metal surfaces with water, that the metal surfaces be contacted with the corrosion inhibitors in the form of an aqueous phase. Accordingly, a desirable property of corrosion inhibitors is that they should be soluble or at least dispersible in water.

Various inorganic and organic compounds are known as water-soluble or water-dispersible corrosion inhibitors. Inorganic corrosion inhibitors can be based, for example, on chromates, nitrites or phosphates which, unfortunately, are more or less toxicologically and ecologically unsafe. Organic corrosion inhibitors are frequently based on carboxylates, amines, amides or on nitrogen-containing heterocyclic compounds. There are serious toxicological objections to the use of secondary amines or compounds capable of releasing secondary amines on account of the possibility of nitrosamine formation. However, other nitrogen-containing compounds are toxicologically unsafe or at least problematical on account of the risk of water pollution. Although carboxylic acids do not have any of these disadvantages, they do not show adequate long-term activity in practice when the pH value of the inhibitor baths is reduced by the introduction of acid or by microbiological processes to such an extent that the carboxylic acids are present not in the salt form, but in the less effective acid form.

EP-B-341 536 describes a water-soluble corrosion inhibitor system containing alkenyl succinic acid, aryl sulfonyl anthranilic acid and alkanolamines. This system does not satisfy the nitrogen-free requirement. GB-B-1,238,205 describes a water-soluble corrosion-inhibiting combination consisting of gluconate and benzoate or salicylate salts. On account of the extremely hydrophilic character of the salts used, this combination is limited in its effectiveness. EP-A-294 649 teaches the use of partly or completely neutralized hydroxyaryl fatty acids as corrosion inhibitors. Although they have a good corrosion-inhibiting effect, they are not readily accessible.

The use of carboxylic acids as corrosion inhibitors, for example in cooling lubricants, cleaners and corrosion-inhibiting emulsions, is widespread in the prior art. For example, DE-A42 29 848 describes a cooling lubricant emulsion of which the corrosion-inhibiting system is based on a combination of long-chain fatty acids, short-chain fatty acids, dimer fatty acids and aromatic carboxylic acids, such as for example benzoic acid or salicylic acid. In this case, the carboxylic acids are neutralized with potassium hydroxide. This system does not contain a buffer component on the lines of the present invention.

German patent application P 43 23 909 describes two-component formulations for cleaning and/or passivating metal surfaces, one component containing the active corrosion inhibitors. The active corrosion inhibitors are selected from i) at least one carboxylic acid corresponding to general formula (III):

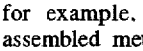

$$R—COOY \quad (III)$$

where R is a linear or branched, saturated or unsaturated alkyl or alkenyl group containing 5 to 21 carbon atoms or a group corresponding to general formula (IV):

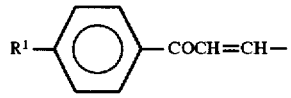

(IV)

where $R^1$ is a saturated, linear or branched alkyl group containing 6 to 18 carbon atoms and Y is hydrogen, an alkali metal ion equivalent or an ammonium ion, ii) substituted benzoic acids, ii) benzene sulfonamidocarboxylic acids, iii) aliphatic dicarboxylic acids containing 2 to 36 carbon atoms and iiii) the salts of the acids mentioned under i) to iii) and mixtures thereof.

This system also does not contain any buffer components for stabilizing the alkaline pH value in the event of introduction or formation of an acid.

Finally, EP-A-556 087 teaches that monocarboxylic acids containing an odd number of carbon atoms, more particularly heptanoic acid, nonanoic acid and undecanoic acid, are particularly effective corrosion inhibitors.

SUMMARY OF THE INVENTION

The problem addressed by the present invention was to provide nitrogen-free water-soluble or water-dispersible corrosion control formulations in which the active corrosion inhibitor would consist of carboxylic acids and which would be safer to use and have a longer life through stabilization against changes in pH.

This problem has been solved by a nitrogen-free water-based corrosion control formulation containing a) carboxylic acid anions containing 6 to 44 carbon atoms and b) aromatic hydroxy compounds having a $pK_a$ value for the hydroxy group of 7.0 to11 in a ratio by weight of 1:2 to 20:1.

DETAILED DESCRIPTION OF THE INVENTION

The aromatic hydroxy compound acts as a buffer component which makes an additional contribution to the corrosion-inhibiting effect. The buffered corrosion control system according to the invention is used in the form of an aqueous emulsion or preferably in the form of an aqueous solution, the particularly effective pH range extending from 8.5 to 10. The invention is based on the observation that the aromatic hydroxy compounds with a $pK_a$ value for the hydroxy group of 7.0 to 11 develop a particularly good buffering effect in the above-mentioned pH range of the ready-to-use formulation. Aromatic hydroxy compounds with a $pK_a$ value for the hydroxy group of 8.5 to 10 are particularly favorable for use in the preferred pH range of 8.5 to 10. Salicylic acid, which has a $pK_a$ value for the hydroxy group of 13.4 (N. Konopik, O. Leberl: "Dissoziationskonstanten sehr schwacher Säuren (Dissociation Constants of Very Weak Acids)", Monatshefte 80 (1949), pages 660 to 662), does not satisfy this requirement.

It is known that the $pK_a$ value is a negative decadic logarithm of the acid constant $K_a$ which is generally known as a thermodynamic value and which is a measure of the completeness of the proton transfer reaction from the acid to water and hence of the acid strength. Relevant particulars can be found in textbooks on general chemistry, cf. for example H. R. Christen: "Grundlagen der aligemeinen und anorganischen Chemie", Verlag Sauerländer, Aarau und Disterweg.Salle, Frankfurt, 4th Edition 1973, pages 353–372. The $pK_a$ value for the hydroxy group of the aromatic hydroxy compounds according to the invention is based on the acid/base reaction of the hydroxy group of the aromatic hydroxy compound with water. The aromatic hydroxy compounds to be used in accordance with the invention may contain carboxylic acid or sulfonic acid groups of which the $pK_a$ values are considerably lower and are of no significance to the buffering effect utilized in accordance with the present invention, but can improve the corrosion-inhibiting effect of the system as a whole.

The corrosion control formulations according to the invention are used in the form of an aqueous preparation, i.e. in the form of an aqueous emulsion or preferably in the form of an aqueous solution. This preparation preferably contains 0.2 to 2% by weight of component a), 0.1 to 0.6% by weight of component b) and, for the rest, water and chemicals for establishing an alkaline pH value, preferably alkali metal hydroxides, potassium hydroxide being preferred for reasons of solubility in the concentrate. This water-based preparation may contain other auxiliaries depending on the application envisaged. The pH value of the waterbased preparation is in the range from 7 to 11 and preferably in the range from 8.5 to 10, for example 9.3.

Component a) is preferably selected from monobasic or polybasic, preferably monobasic, saturated or mono- or polyunsaturated linear or branched carboxylic acids containing 6 to 22 carbon atoms and/or unsaturated polybasic, preferably dibasic, carboxylic acids containing 36 to 44 carbon atoms. Examples of carboxylic acids containing 6 to 22 carbon atoms are the unbranched saturated carboxylic acids hexanoic acid, octanoic acid and decanoic acid and, in particular, the monocarboxylic acids containing an odd number of carbon atoms which are preferably used under the teaching of EP-A-556 087, more particularly heptanoic acid, nonanoic acid and undecanoic acid. Particular technical advantages are also afforded by branched saturated carboxylic acids, more particularly 2ethyl hexanoic acid, 3,5,5-trimethyl hexanoic acid and 2,2-dimethyl octanoic acid. One example of a preferred unsaturated short-chain carboxylic acid is 1 ,4-hexadienoic acid (sorbic acid). In addition, saturated or unsaturated fatty acids containing 12 to 22 carbon atoms in the molecule are generally usable as are the technical mixtures thereof which are obtained, for example, in the hydrolysis of natural fats and oils or which may even be synthesized. Examples include oleic acid and the technical mixtures of various fatty acids known as tall oil fatty acid which may be obtained from tall oil and which consists mainly of linoleic acid and conjugated $C_{18}$ fatty acids, oleic acid and 5,9,12-octadecatrienoic acid. In addition, alkyl phenyl-substituted unsaturated carboxylic acids of the following type:

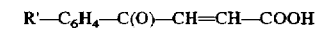

$$R'—C_6H_4—C(O)—CH=CH—COOH$$

or

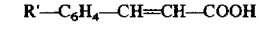

$$R'—C_6H_4—CH=CH—COOH$$

where R' is a linear or branched alkyl group containing 8 to 14 carbon atoms, may also be used.

Unsaturated polybasic carboxylic acids containing 36 to 44 carbon atoms, of which the dibasic representatives are preferably used, are also known as "dimer fatty acids". They may be obtained on an industrial scale by —generally acid-catalyzed—dimerization of suitable unsaturated fatty acids containing 18 to 22 carbon atoms. The reaction products are generally mixtures of acids with different degrees of oligomerization together with unreacted or isomerized starting materials. Such products are commercially obtainable, for example from Unichema under the product group name of Pripol® or from Henkel KGaA under the product group name of Empol®.

Besides the carboxylic acid components a), of which the corrosion-inhibiting effect is already known in the prior art, the aromatic hydroxy compound b) acting as buffer is also particularly important in stabilizing the corrosion-control formulation against the introduction or formation of acid and, hence, in keeping it usable for a longer period than non-buffered systems in the absence of further corrective measures. The aromatic hydroxy compounds selected have the advantage over other possible buffer systems for the pH range from 7 to 11 that they support the corrosion-inhibiting effect of the carboxylic acid components. Component b) is preferably selected from mono-, di- or trinuclear aromatic hydroxy compounds corresponding to general formula (I):

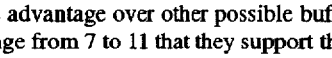

$$HO—Arom—X \quad (I)$$

where X is selected from the substituents COOH, $SO_3H$ or $SO_2—C_6H_4—OH$ and "Arom" represents a mono-, di- or trinuclear carbocyclic aromatic 6-membered ring system of the benzene, naphthalene, anthracene or phenanthrene type which may contain further substituents X, OH and/or alkyl, hydroxyalkyl and/or hydroxyalkyl ether groups containing 1 to about 4 carbon atoms. Hydroxyalkyl ether groups such as, for example, ethylene glycol ether or propylene glycol ether groups can be obtained, for example, by ethoxylation or propoxylation of phenols.

Component b) is preferably selected from mononuclear aromatic hydroxy compounds which may be represented by general formula (II):

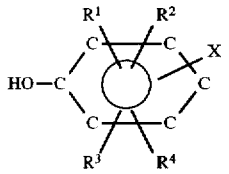

(II)

in which X is selected from the substituents COOH, $SO_3H$ or $SO_2$—$C_6H_4$—OH and $R^1$, $R^2$, $R^3$ and $R^4$ independently of one another represent a group X, H, OH or an alkyl, hydroxyalkyl or hydroxyalkyl ether group containing 1 to 4 carbon atoms.

Preferred compounds of general formula (II) are those which contain only one substituent X, preferably in the para position to the hydroxyl group, and in which the substituents $R^1$, $R^2$, $R^3$ and $R^4$ are preferably hydrogen. The substituent X is preferably one of the groups COOH, $SO_3H$ or $SO_2$—$C_6H_4$—OH. Particularly suitable examples of such compounds are 4-hydroxybenzoic acid, 4-phenol sulfonic acid and 4,4'-dihydroxydiphenyl sulfone (bisphenol S).

Compounds containing a carboxylic acid or sulfonic acid function will largely be present in the form of their carboxylate or sulfonate anions at the pH value of the in-use solution of 7 to 11. Since hydroxy compounds of which the $pK_a$ value for the hydroxy group is 7.0 to 11 are used in accordance with the invention, the hydroxy groups can be expected to be partly deprotonated in the pH range selected. Particulars of the determination of the $pK_a$ values of the only weakly acidic hydroxy groups can be found in the article by Konopik cited earlier on. Further information on $pK_a$ measurements can be found in: B. Jones, J. C. Speakman: "Thermodynamic Dissociation Constants of Hydroxy- and Alkoxy-benzoic Acids", J. Chem. Soc. 1944, pages 19 to 20. According to this article, m- and p-hydroxybenzoic acid have $pK_a$ values of 9.94 and 9.39, respectively. The $pK_a$ value of 4-phenol sulfonic acid for the phenolic hydroxy group was found to be 8.9 while that of bisphenol S was found to be 9.5. By contrast, the dissociation constant of salicylic acid in regard to the OH group is so low that it could not be determined by the method selected here of potentiometric titration using a glass electrode.

For its required long-term stability, the ready-to-use aqueous corrosion-inhibiting solution or dispersion should preferably have a buffering capacity of 1 to 8. The buffering capacity is defined as the consumption of 0.1 normal hydrochloric acid, as measured in ml, required to lower the pH value of 50 g of the corrosion-control formulation by 1.3 units, for example to titrate 50 g of the corrosion-control formulation from a pH value of 9.3 to a pH value of 8. Where components a) are used, buffering capacities of this order can be obtained by combining the components a) with components b) in accordance with the present invention.

Buffering capacities of a similar order could also be obtained by combining components a) with other buffers, for example with suitable amines, borates or phosphates. However, amines should not be used for the reasons mentioned at the beginning. The teaching according to the invention also eliminates the need to use the other ecologically unsafe buffer systems, such as borates or phosphates.

The concentrations mentioned above for the corrosion-control formulations suitable for use in accordance with the invention apply to the ready-to-use aqueous preparations. In principle, they may be prepared in situ by dissolving or dispersing the individual components in water in the concentration ranges mentioned. However, it is standard practice in the technical field in question to market active-substance combinations such as these in the form of concentrates which already contain all components in the necessary quantity ratios and from which the ready-to-use treatment baths can be prepared in situ by dilution with water. Accordingly, the present invention also relates to water-based active-substance concentrates which contain components a) and b) in the quantities shown in claim 1. The active-substance concentrations in these concentrates are preferably adjusted in such a way that an aqueous corrosion control formulation having the properties described above is obtained by diluting the concentrate with water by a factor of about 20 to about 200.

EXAMPLE S

According to the Table, active-substance concentrates were prepared from the inhibitor component a) and the buffer component b) by dissolving or dispersing the individual components in deionized water in the concentrations shown in the Table and adding KOH in such a quantity that a solution diluted by a factor of 50 with deionized water had a pH value of 9.3.

The buffering capacity was determined by titrating 50 g of the concentrate solution diluted in a ratio of 1:50 with 0.1 normal hydrochloric acid from pH 9.3 to pH 8. The consumption of hydrochloric acid in ml required for this purpose is the buffering capacity.

The corrosion control effect was tested in a plate conditioning test. To this end, ST 1405 steel plates measuring 5 cm×10 cm were brushed with an aqueous surfactant solution, rinsed with water and alcohol and dried. The plates were then immersed in the concentrate solutions according to the Table diluted by a factor of 50 with deionized water, allowed to drain and then placed in a conditioning chamber at 22° C./76% relative air humidity. All the Examples produced the necessary corrosion control (less than 30% corrosion after a test duration of 40 days). The formulation of Example 10 was also tested in more heavily diluted form. The necessary corrosion-inhibiting effect was also achieved when the concentrate was diluted by a factor of 75.

TABLE

Active-substance Concentrates, Concentrations in % by weight in Water/KOH

| No. | Inhibitor a) | Conc. | Buffer b) | Conc. (%) | Buffering capacity (ml) |
|---|---|---|---|---|---|
| Comp. 1 | Heptanoic acid | 20 | — | | 0.06 |
| Comp. 2 | Sorbic acid | 20 | — | | 0.03 |
| Comp. 3 | Heptanoic acid | 20 | Salicylic acid | 5 | <0.1 |
| Example 1 | tall oil fatty acid | 20 | 4-Hydroxy-benzoic acid | 5 | 1.6 |
| Example 2 | Oleic acid | 20 | 4-Hydroxy-benzoic acid | 5 | 2.6 |
| Example 3 | Dimer fatty acid (Empol ® 1022, Henkel KGaA) | 20 | 4-Hydroxy-benzoic acid | 5 | 1.6 |
| Example 3 | Heptanoic acid | 20 | 4-Hydroxy-benzoic acid | 5 | 2.0 |
| Example 4 | Sorbic acid | 20 | 4-Hydroxy-benzoic acid | 5 | 1.8 |
| Example 5 | Sorbic acid | 20 | 4-hydroxy-benzoic acid | 10 | 5.0 |
| Example 6 | Sorbic acid | 20 | 4-hydroxy-benzoic acid | 20 | 6.0 |
| Example 7 | Sorbic acid | 20 | Bisphenol S | 5 | 1.6 |
| Example 8 | Heptanoic acid | 20 | 4-Phenol-sulfonic acid | 5 | 1.6 |
| Example 9 | Heptanoic acid + | 10 | 4-Hydroxy- | 5 | 2.0 |

TABLE-continued

| Active-substance Concentrates, Concentrations in % by weight in Water/KOH | | | | | |
|---|---|---|---|---|---|
| No. | Inhibitor a) | Conc. | Buffer b) | Conc. (%) | Buffering capacity (ml) |
| | sorbic acid | 10 | benzene sulfonic acid | | |
| Example 10 | 3,5,5-trimethyl hexanoic acid + sorbic acid | 10 | 4-Hydroxy-benzene sulfonic acid | 10 | 5.2 |

We claim:

1. An aqueous corrosion control formulation comprising:

a. a carboxylic acid having 6 to 44 carbon atoms; and b. an aromatic hydroxy compound having a $pK_a$ of 7.0 to 11, wherein a. and b. are present in a weight ratio of 1:2 to 20:1, wherein said formulation is free of nitrogen, and wherein said formulation has a buffering capacity of 1 to 8.

2. A corrosion control formulation according to claim 1, comprising 0.2% to 2% by weight carboxylic acid, 0.1% to 0.6% by weight aromatic hydroxy compound, and an amount of a base sufficient to provide said formulation with an alkaline pH.

3. A corrosion control formulation according to claim 2, wherein said base is an alkali metal hydroxide.

4. A corrosion control formulation according to claim 3, wherein said base is potassium hydroxide.

5. A corrosion control formulation according to claim 2, wherein said pH has a value of 7 to 11.

6. A corrosion control formulation according to claim 5, wherein said pH has a value of 8.5 to 10.

7. A corrosion control formulation according to claim 1, wherein said carboxylic acid is:

a. a mono- or polybasic, mono- or polyunsaturated or saturated, linear or branched carboxylic acid having 6 to 22 carbon atoms; or b. an unsaturated polybasic carboxylic acid having 36 to 44 carbon atoms.

8. A corrosion control formulation as claimed in claim 1, wherein said aromatic hydroxy compound is a compound of the formula (I)

$$HO—Arom—X \quad (I)$$

wherein X is COOH, $SO_3H$, or $SO_2—C_6H_4—OH$ and Arom is a mono-, di-, or trinuclear carbocyclic aromatic 6-membered ring that can be further substituted by X, OH, $C_1$–$C_4$-alkyl, $C_1$–$C_4$-hydroxyalkyl, or $C_1$–$C_4$-hydroxyalkyl ether.

9. A corrosion control formulation according to claim 8, wherein said aromatic hydroxy compound is a compound of the formula (II)

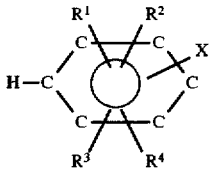

(II)

wherein X is COOH, $SO_3H$, or $SO_2—C_6H_4—OH$ and $R^1$, $R^2$, $R^3$, and $R^4$ are independently X, H, OH, $C_1$–$C_4$-alkyl, $C_1$–$C_4$-hydroxyalkyl, or $C_1$–$C_4$-hydroxyalkyl ether.

10. A corrosion control formulation according to claim 9, wherein $R^1$, $R^2$, $R^3$, and $R^4$ are H.

11. A corrosion control formulation according to claim 1, wherein said carboxylic acid is selected from the group consisting of hexanoic acid, octanoic acid, decanoic acid, nonanoic acid, undecanoic acid, 2-ethylhexanoic acid, 2,2-dimethyloctanoic acid, linoleic acid, conjugated C18 fatty acids, 5,9,12-octadecatrienoic acid, tall oil fatty acid, oleic acid, dimer fatty acid, heptanoic acid, sorbic acid, and 3,5,5-trimethylhexanoic acid and said aromatic hydroxy compound is selected from the group consisting of 4-hydroxybenzoic acid, bisphenol S, 4-phenolsulfonic acid, and 4-hydroxybenzene sulfonic acid.

* * * * *